US008201269B2

(12) United States Patent
Maddux et al.

(10) Patent No.: US 8,201,269 B2
(45) Date of Patent: Jun. 19, 2012

(54) TPU/FOAM JAW PAD

(75) Inventors: Larry E. Maddux, Salem, IL (US); Raymond J. Drake, Jr., Salem, IL (US); Louis Anthony VanHoutin, Luka, IL (US); Vincent R. Long, St. Peters, MO (US); Cortney Warmouth, Edwardsville, IL (US)

(73) Assignee: Kranos IP Corporation, Litchfield, IL (US)

( * ) Notice: Subject to any disclaimer, the term of this patent is extended or adjusted under 35 U.S.C. 154(b) by 380 days.

(21) Appl. No.: 12/634,447

(22) Filed: Dec. 9, 2009

(65) Prior Publication Data

US 2011/0131695 A1 Jun. 9, 2011

(51) Int. Cl.
*A42B 1/00* (2006.01)

(52) U.S. Cl. ..... 2/9; 2/424; 2/425

(58) Field of Classification Search ..... 2/410, 411, 2/414, 412, 415, 420, 425, 417–419, 455, 2/10, 9
See application file for complete search history.

(56) References Cited

U.S. PATENT DOCUMENTS

| | | | | | |
|---|---|---|---|---|---|
| 40,422 | A | * | 10/1863 | Miles | 280/143 |
| 3,609,764 | A | * | 10/1971 | Morgan | 2/414 |
| 3,713,640 | A | * | 1/1973 | Margan | 267/117 |
| 3,843,970 | A | * | 10/1974 | Marietta et al. | 2/415 |
| 4,023,213 | A | * | 5/1977 | Rovani | 2/413 |
| 4,432,099 | A | * | 2/1984 | Grick et al. | 2/412 |
| 4,477,929 | A | * | 10/1984 | Mattsson | 2/425 |
| 4,558,470 | A | * | 12/1985 | Mitchell et al. | 2/414 |
| 4,586,200 | A | * | 5/1986 | Poon | 2/413 |
| 4,619,055 | A | * | 10/1986 | Davidson | 36/28 |
| 4,627,114 | A | * | 12/1986 | Mitchell | 2/414 |
| 4,677,694 | A | * | 7/1987 | Crow | 2/9 |
| 4,724,549 | A | * | 2/1988 | Herder et al. | 2/411 |
| 4,831,668 | A | * | 5/1989 | Schulz | 2/414 |
| 4,837,866 | A | * | 6/1989 | Rector et al. | 2/424 |
| 4,853,980 | A | * | 8/1989 | Zarotti | 2/413 |
| 4,916,759 | A | * | 4/1990 | Arai | 2/414 |
| 5,035,009 | A | * | 7/1991 | Wingo et al. | 2/414 |
| 5,168,576 | A | * | 12/1992 | Krent et al. | 2/456 |
| 5,518,802 | A | * | 5/1996 | Colvin et al. | 428/178 |
| 6,138,284 | A | * | 10/2000 | Arai | 2/414 |
| 6,272,692 | B1 | * | 8/2001 | Abraham | 2/411 |
| D492,818 | S | * | 7/2004 | Ide et al. | D29/122 |
| 6,934,971 | B2 | * | 8/2005 | Ide et al. | 2/425 |
| 7,673,351 | B2 | * | 3/2010 | Copeland et al. | 2/425 |
| 8,069,498 | B2 | * | 12/2011 | Maddux et al. | 2/414 |
| 2004/0025231 | A1 | * | 2/2004 | Ide et al. | 2/425 |
| 2006/0143807 | A1 | * | 7/2006 | Udelhofen et al. | 2/425 |
| 2010/0299812 | A1 | * | 12/2010 | Maddux et al. | 2/414 |
| 2011/0271430 | A1 | * | 11/2011 | Lowe et al. | 2/425 |
| 2012/0017358 | A1 | * | 1/2012 | Princip et al. | 2/414 |

* cited by examiner

*Primary Examiner* — Katherine Moran
*Assistant Examiner* — Richale Quinn
(74) *Attorney, Agent, or Firm* — Notaro, Michalos & Zaccaria P.C.

(57) ABSTRACT

A protective jaw pad for equipment having a shell includes a first resilient shock absorbing member having a sheet portion with a plurality of hollow protrusions, tapering side walls of the protrusions being compressible for absorbing shocks applied to the shell. The pad includes a second resilient shock absorbing member that is either a monolithic block of foam or is made up of a second sheet portion with a plurality of hollow protrusions that are interleaved with the first protrusion. A cover covers either the first or the second shock absorbing member and a plurality of fasteners removably connect the jaw pad to the shell.

8 Claims, 5 Drawing Sheets

FIG. 9
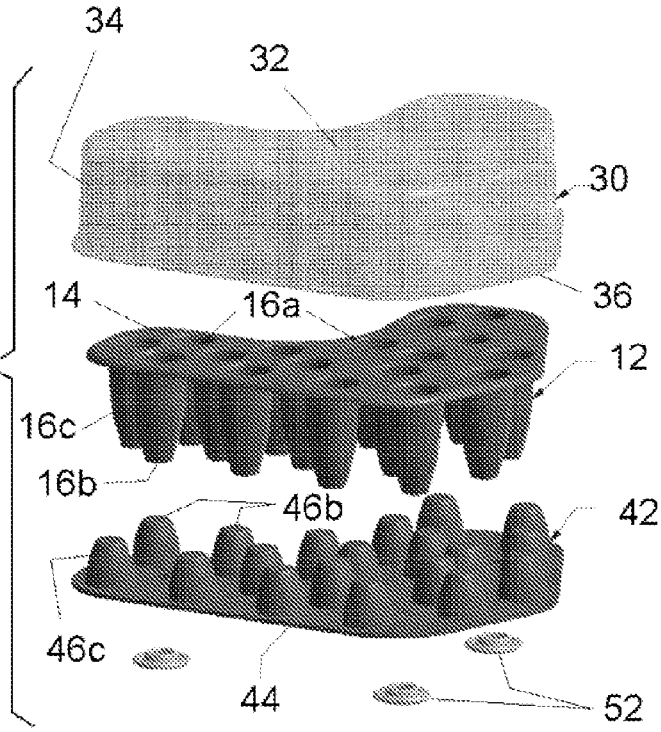
FIG. 10
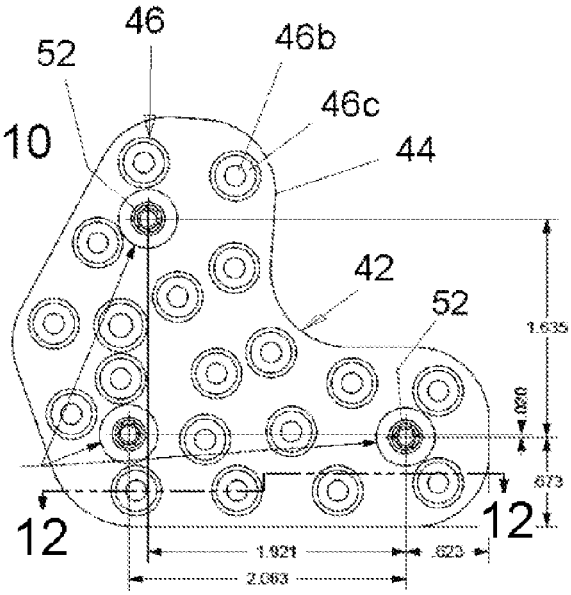
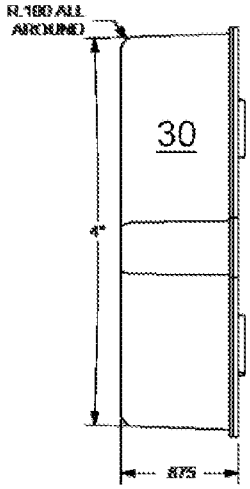
FIG. 11

TPU/FOAM JAW PAD

FIELD AND BACKGROUND OF THE INVENTION

The present invention relates generally to the field of protective equipment and, in particular, to a new and useful protective jaw pad for sports or other protective equipment, and most particularly to a jaw pad for football and other sports helmets.

U.S. patent application Ser. No. 12/476,534 filed Jun. 2, 2009 for a PROTECTIVE ARRANGEMENT, to the co-inventors of the present application, is incorporated here by reference for its showing of the construction, materials and placement of impact absorbing pads comprising inner and outer sheets having alternating protrusions that form an impact absorbing pattern in the space between the sheets. An important impact absorbing feature of these pads is that each protrusion of one sheet has a flat peak that is fused to the other sheet. In this way both sets of protrusions begin to collapse immediately upon receiving an impact to start resisting the impact by there deformation as the protrusions are compressed.

Although very useful for most areas of the head, a more gradual collapse dynamic may be preferable in other areas of the head, such as at the sides of the jaw of a person wearing the helmet.

Examples of jaw pads for helmets can be found, of example, in U.S. Pat. No. 4,060,855 to Rappleyea for PAD FOR PROTECTIVE HELMET; U.S. Pat. No. 6,370,699 to Halstead et al., for JAW PAD FOR HELMET; and U.S. Pat. No. 6,934,971 to Ide et al. for FOOTBALL HELMET.

A need remains for a protective jaw pad that has improved shock absorption characteristics.

SUMMARY OF THE INVENTION

It is an object of the present invention to provide a protective jaw pad for equipment such as a helmet having a shell, the pad including a first resilient shock absorbing member having a sheet portion with a plurality of hollow protrusions, tapering side walls of the protrusions being compressible for absorbing shocks applied to the shell. The pad includes a second resilient shock absorbing member that is either a monolithic block of foam or is made up of a second sheet portion with a second plurality of protrusions that are interleaved with the first protrusion. A cover covers either the first and second shock absorbing members or the second member only, and a plurality of fasteners removably connect the jaw pad to an inner surface of the shell that is near the wearer's jaw when the shell is worn.

Another object of the invention is to provide a protective jaw pad with shock absorbing components made of thermoplastic polyurethane (TPU).

An still further object of the invention is to provide a protective jaw pad with first and second shock absorbing members that are each made up of a sheet portion with a plurality of hollow protrusions that are interleaved with each other, the crests of the first set of protrusions being sealed, e.g. by heat welding, to the sheet portion of the other member, and the crests of the second set of protrusions being shorter than the first so that they are spaced from the first sheet portion, absorption of shock to the shell being performed in two stages, the first during compression and collapse of the first set of protrusions until the second crests meet the inner surface of the first sheet portion, and the second stage being when the second protrusions compress and collapse.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 9 is an exploded view of a left jaw pad of a second embodiment of the invention;

FIG. 10 is an inside plan view of the left jaw pad of the second embodiment of the invention;

FIG. 11 is rear elevational view of the left jaw pad of the second embodiment of the invention;

DESCRIPTION OF THE PREFERRED EMBODIMENTS

Figure 1:
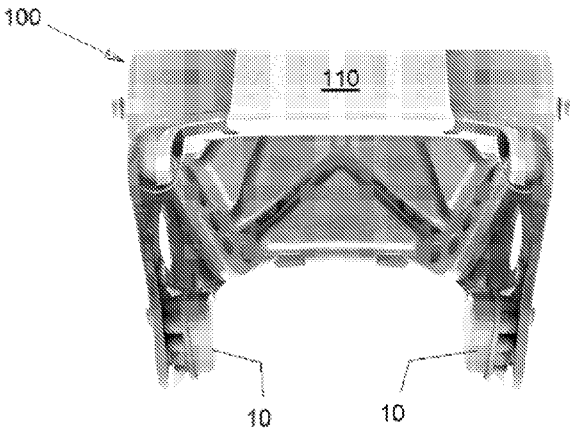
FIG. 1 is a front elevational view of a first embodiment of a pair of protective jaw pads of the invention connected to the inner surface of the shell of a football helmet.
Figure 2:
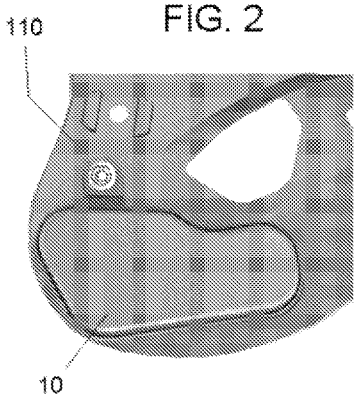
FIG. 2 is an outside plan view of a right jaw pad of FIG. 1, in the right side of the helmet shell.
Figure 3:
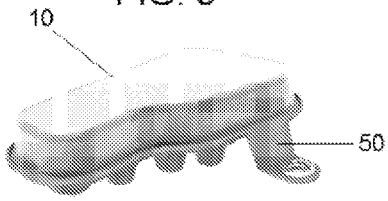
FIG. 3 is a perspective view of the first embodiment of the pad of FIG. 2.

Referring now to the drawings, in which like reference numerals are used to refer to the same or similar elements, FIGS. 1 and 2 show a pair of protective jaw pads 10 for protective equipment such as a football helmet 100, having a hard plastic shell 110 for extending to the side of a wearer's jaw.

FIGS. 3 to 8 illustrate a first embodiment of the invention wherein each pad comprises a first shock absorbing member 12 of resilient, preferably TPU or thermoplastic polyurethane elastomer. The first shock absorbing member 12 is formed, preferably by injection molding, and has a planar sheet portion 14 with a generally L-shaped coverage area adapted for overlying at least part of a side of a jaw of a wearer of the equipment, and a plurality of hollow protrusions 16 made as one piece with the sheet portion 14 and distributed around the coverage area. The protrusions 16 each having a large diameter open base **16*a* opening into the sheet portion 14, a small diameter preferably closed and preferably flat crest 16*b* spaced for the base, and a tapering side wall 16*c* extending from the sheet portion 14 to the crest 16*b***.

Each tapering side wall **16*c* is compressible for absorbing shocks applied to the shell 110 and the bases 16*a* are spaced from each other for distributing shock absorbing effects of the protrusions 16 around the coverage area of the sheet portion 14. An elongated generally L-shaped left and right jaw pad is provided in the pair, with the left pad shown in FIGS. 2 and 3 and the right pad shown in FIGS. 4 to 8**.

Each pad also includes a second shock absorbing member 20 of resilient elastomer that overlies to the first shock absorbing member 12 and which also extends over the coverage area for further absorbing shocks applied to the shell. A cover 30 of resilient elastomer covers at least one of the first and second shock absorbing members according to the invention, and, in the embodiment of FIGS. 1 to 8, the second shock absorbing member 20 is the member covered. A plurality of fasteners, such as female snaps 52 fixed by concentric rings 54 to parts of the shock absorbing members, removably connect each jaw pad 10 to the shell 110 via corresponding male snaps in the shell.

The crests of the protrusions 16 are closer to the shell than the sheet portion 14 of the first shock absorbing member 14 to compress as a sudden force or impact is applied to the shell. To this end the tapering side walls 16*c* of the protrusions 16 of the first shock absorbing member 12 having a first length for spacing the sheet portion 14 from the shell by at least the first length to absorb the shock. In the embodiment of FIG. 3 to 8 the second shock absorbing member 20 is a monolithic block of foam having an inner surface corresponding to, and extending over the coverage area of the sheet portion 14, on a side of the sheet portion that is opposite from the protrusions 16, and therefore closed to the wearer's jaw. The monolithic block has an opposite outer surface and side walls that are covered by the cover 30. The cover has a perimeter that is sealed to a perimeter of the sheet portion 14 as best shown in FIG. 5. Foam member 20 is preferably die cut of Omalon material. Sealing of the perimeter of cover 30 to sheet portion 14 fixes the second shock absorbing member 20 to the first member 12.

Figure 4:
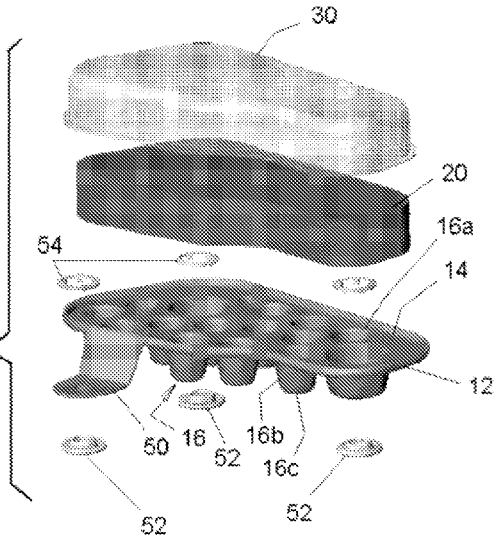
FIG. 4 is an exploded view of a left jaw pad of the first embodiment.
Figure 5:
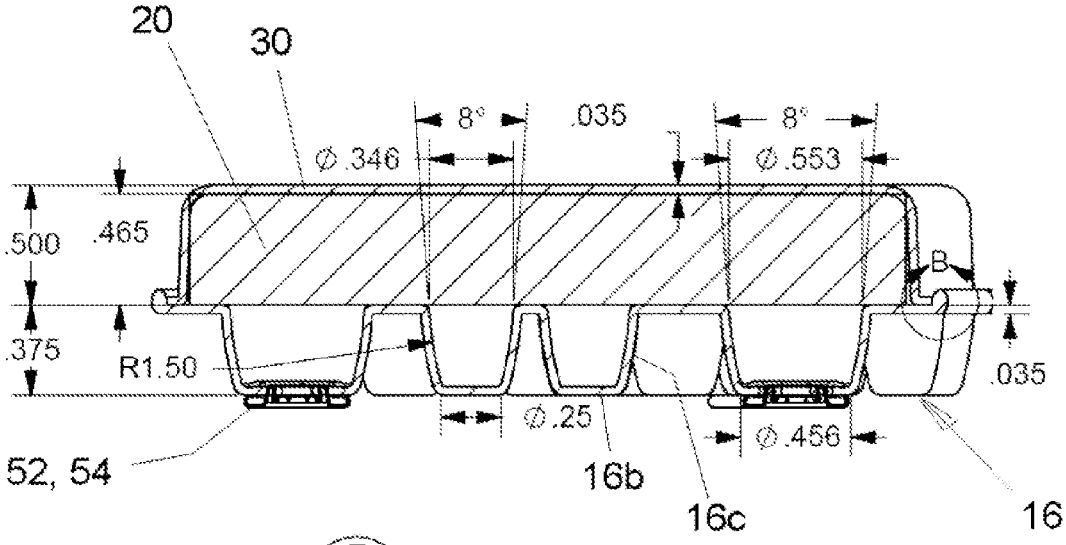
FIG. 5 is a sectional view of the left jaw pad of FIG. 4, taken along line 5-5 of FIG. 8.

The monolithic block of foam making up the second member 20 in FIG. 4 is advantageously memory foam and the first shock absorbing member 12 is preferably made of thermoplastic polyurethane and having a durometer of 80 shore A to 100 shore A, and most preferably 90 shore A. Cover 30 is preferably clear with a tint, e.g. a blue tint, and is an elastomeric material known as Bayer DP6065A that has been thermoformed or injection molded and has a harness of durometer 65 shore A. Bayer DP6065A is a TPU material.

Figure 6:
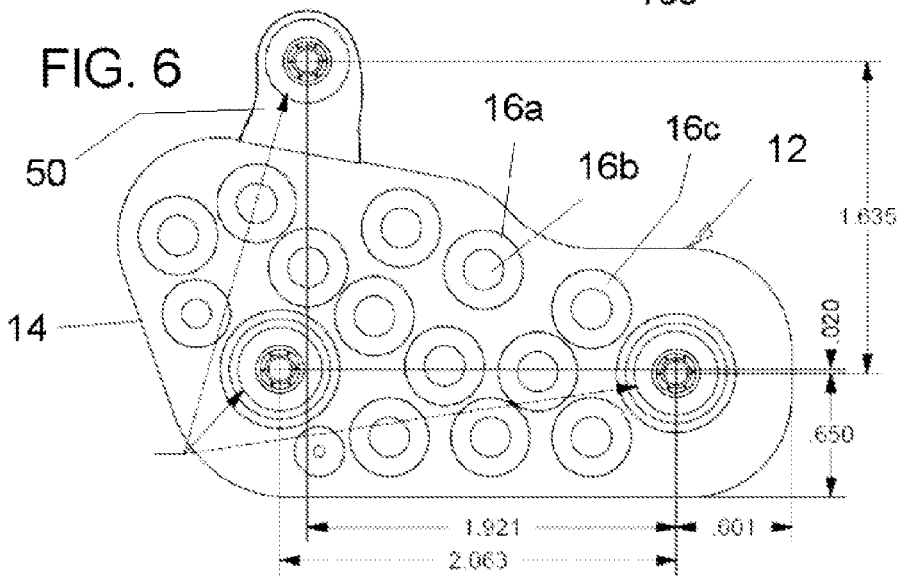
FIG. 6 is an inside plan view of the jaw pad of FIG. 4, showing the surface of the jaw pad that faces the helmet shell.
Figure 7:
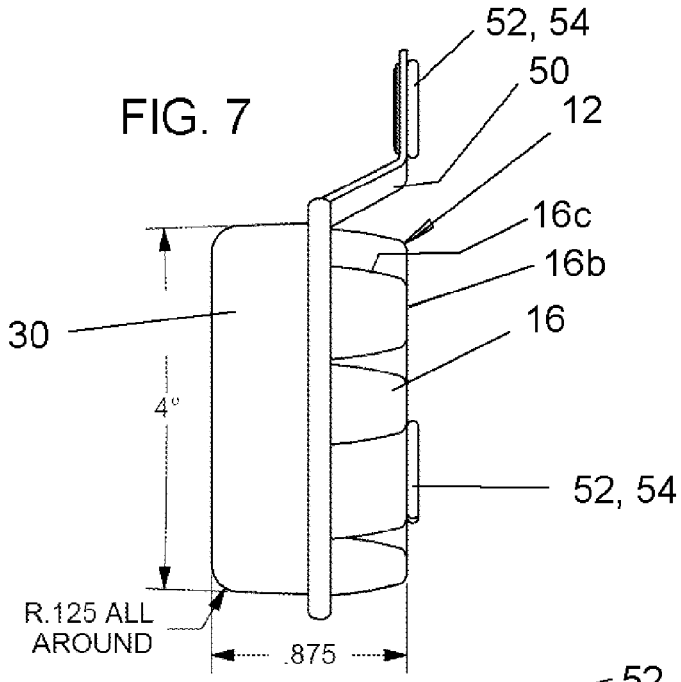
FIG. 7 is a front elevational view of the jaw pad of FIG. 4.
Figure 8:
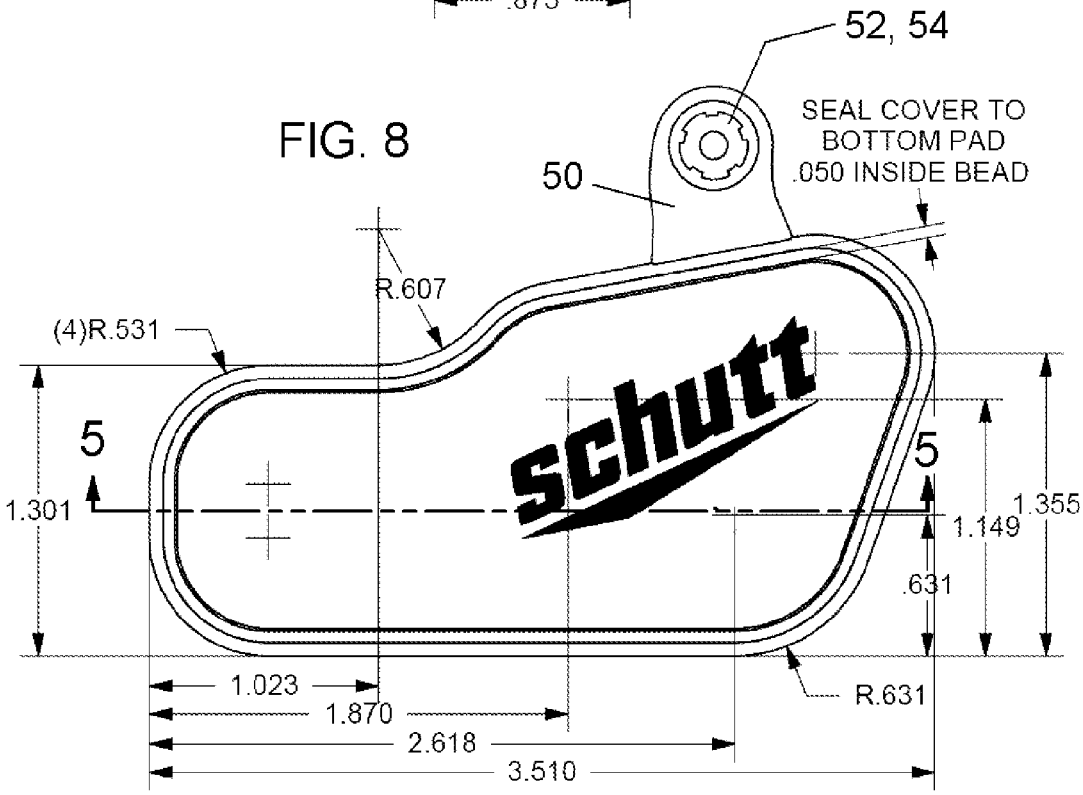
FIG. 8 is an outside plan view of the jaw pad of FIG. 4, showing the surface of the pad that is meant to contact the wearer's jaw.

Two snap fasteners 52, 54 are advantageously fixed to the crests of two of the protrusions 16 in the coverage area as shown in FIG. 6, and a third is fixed to a tab 50 extending at an angle from the sheet portion 14 as shown in FIGS. 3, 4, 6, 7 and 8.

FIGS. 9 to 13 illustrate a second embodiment of the invention that has first and second shock absorbing members 12 and 42 that both are injection molded preferably of TPU, each having a planar sheet portion with the same generally L-shaped coverage area adapted for overlying at least part of a side of a jaw of a wearer of the equipment, and each with a plurality of protrusions made as one piece with the sheet but with the protrusions interleaves with each other, and, importantly, one set of protrusions being shorter than the other.

The generally L-shape for the coverage area of each pad (the left being an mirror image of the right) has been selected to better mimic the shape of the wearer's jaw that includes a generally horizontal mandible that carries the lower teeth, and a generally vertical ramus that hinges the jaw to the temporal bone of the wearer's skull.

While the first shock absorbing member 12 of the second embodiment is similar in structure to the first shock absorbing member in the first embodiment of FIGS. 3 to 8, the second shock absorbing member 42 is formed of a second sheet portion 44 with a coverage area corresponding to the area of the first-mentioned sheet portion 14 of the first shock absorbing member 12 and is placed under rather than over the first shock absorbing member. The second sheet portion 44 has a plurality of second hollow protrusions 46 that are made as one piece with the second sheet portion 44 and are distributed around the area of the second sheet portion. The second protrusions 46 each having a large diameter open second base 46*a* opening into the second sheet portion 44, a small diameter preferably closed and flat second crest 46*b* spaced for a respective second base, and a tapering second side wall 46*c* extending from the second sheet portion 44 to the second crest 46*c* of each second protrusion 46. The first and second plurality of protrusions 16 and 46 both extend into the space between the sheet portions 14 and 44.

Each second tapering side wall 46*c* has a second length that is shorter, e.g. by about 30 to 70% shorter, than the first length of the first-mentioned protrusions 16 of the first-mentioned sheet portion 14 so that the second crests 46*b* are spaced from the first-mentioned sheet portion 14. The first-mentioned 16, and second protrusions 46 are interleaved with each other and the crests of first-mentioned protrusions 16 are sealed to the second sheet portion 44 between the second bases 46*a*, preferably by heat welding.

In operation to absorb a shock to the jaw, each tapering second side wall 46*c* is compressible for further absorbing shocks applied to the shell, only after the first-mentioned tapering side walls 16*c* of the first-mentioned protrusions 16 have been compressed sufficiently to bring the second crests into contact with the first-mentioned sheet portion 14. All of the bases are spaced from each other for distributing shock absorbing effects of all the protrusions around the coverage area of the sheet portion.

Figure 12:
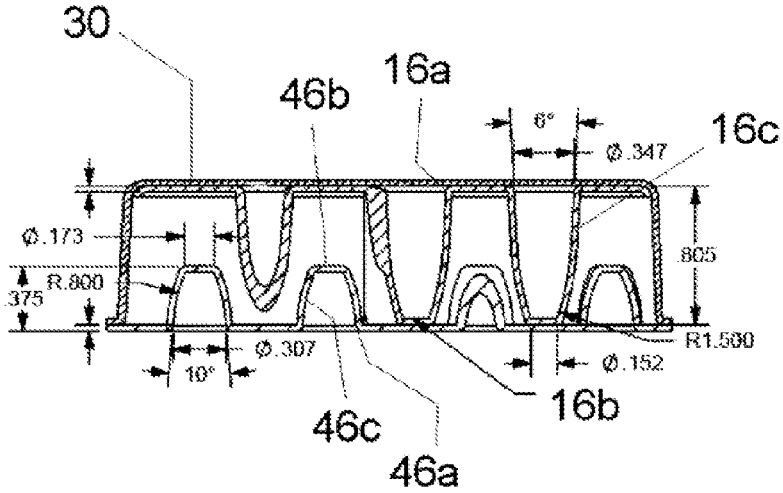
FIG. 12 is a sectional view of the left jaw pad of the second embodiment of the invention taken alone line 12-12 of FIG. 10.
Figure 13:
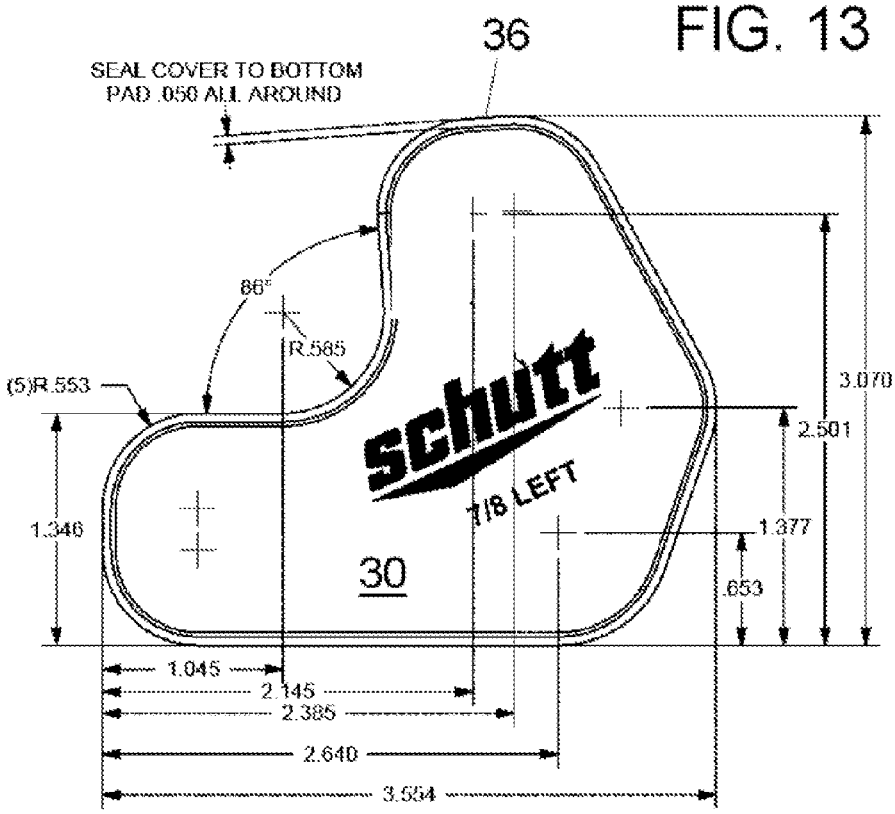
FIG. 13 is an outside plan view of the left jaw pad of the second embodiment of the invention.

The protective jaw pad of FIGS. 9 to 13 also has a cover 30 but which covers both of the first and the second shock absorbing members 12 and 42. Cover 30 has an outer wall 32 extending substantially across the coverage area of the sheet portions 14 and 44, a side wall 34 extending around the sheet portions and protrusions of the shock absorbing members, and a perimeter 36 sealed by heat welding to a perimeter of the second sheet portion 44 as best shown in FIG. 12. Cover 30 is preferably thermoformed or injection molded of blue-tinted, clear Bayer DP6065A, with durometer 65 shore A elastomer material.

As shown in FIG. 10 snap fasteners are spaced along the coverage area, e.g. at the corners of a triangle, by being fixed to selected locations of the second sheet portion 44, corresponding to crests 16*b* of protrusions of the first shock absorbing member 12 that have been heat sealed the sheet portion 44 at these locations. This provides a double thickness of sheet material to better resist tearing when the snaps are engaged and disengaged from the shell, for installing and removing the jaw pads.

In the embodiment of FIGS. 9 to 13, the first shock absorbing member 12 is preferably injection molded of TPU elastomer such as Bayer DP6065A durometer 65 shore A and the second shock absorbing member 42 is preferably injection molded of TPU elastomer such as Bayer U-90A10 of durometer 90 shore A so that the second member 42 is of higher durometer (i.e. is harder) than the first member 12 in this embodiment.

As best shown in FIG. 12, the crests 16*b* of the first sheet portion 12 are heat sealed or welded to the inside surface of the second sheet portion 44. This fixes the relative positions of the first crests 16*b* with respect to the second sheet portion 44 to help keep the first set of protrusions 16 lined up as they collapse under the influence of a shock or force being applied to the pad 10.

Although a preferred use of the jaw pad of the invention is in football helmets, jaw protective pads of the invention can be used in various other sports helmets such as those for baseball, lacrosse, hockey, bicycling, motor cycling, climbing, car, boat and airplane operation, and other motor racing and operation, and for non-sport helmets such as for construction workers or other crash helmets or headgear where protection of the jaw is desired, or for other protective equipment for protecting a body part from impact by providing an impact protective pad.

The designations first, second, upper, lower, etc, are used for convenience only to differential the various parts of the invention and do not indication a limitation to the scope of the invention.

While specific embodiments of the invention have been shown and described in detail to illustrate the application of the principles of the invention, it will be understood that the invention may be embodied otherwise without departing from such principles.

What is claimed is:

1. In combination with a protective helmet having a shell, a protective jaw pad for extending to the side of a wearers jaw, the pad comprising:

a first shock absorbing member of resilient elastomer having a sheet portion with a coverage area adapted for overlying at least part of a side of a jaw of a wearer of the protective helmet, and a plurality of hollow protrusions made as one piece with the sheet portion and distributed around the coverage area, the protrusions each having a large diameter base opening into the sheet portion, a small diameter closed and flat crest spaced for the base, and a tapering side wall extending from the sheet portion to the crest, each tapering side wall being compressible for absorbing shocks applied to the shell and the bases being spaced from each other for distributing shock absorbing effects of the protrusions around the coverage area of the sheet portion;

a second shock absorbing member of resilient elastomer connected to the first shock absorbing member and extending over the coverage area for further absorbing shocks applied to the shell;

a cover of resilient elastomer covering at least one of the first and second shock absorbing members; and a plurality of fasteners for removably connecting the jaw pad to the shell with the crests of the protrusions being closer to the shell than the sheet portion of the first shock absorbing member;

the tapering side walls of the protrusions of the first shock absorbing member having a first length for spacing the sheet portion from the shell by at least the first length;

wherein the second shock absorbing member has a second sheet portion with a coverage area corresponding to the coverage area of the first-mentioned sheet portion of the first shock absorbing member, the second sheet portion having a plurality of second hollow protrusions made as one piece with the second sheet portion and distributed around the coverage area of the second sheet portion, the second protrusions each having a large diameter second base opening into the second sheet portion, a small diameter closed and flat second crest spaced for a respective second base, and a tapering second side wall extending from the second sheet portion to the second crest of each second protrusion, each second tapering side wall have a second length that is shorter than the first length of the first-mentioned protrusions of the first-mentioned sheet portion so that the second crests are spaced from the first-mentioned sheet portion, the first-mentioned and second protrusions being interleaved with each other and the crests of first-mentioned protrusions being sealed to the second sheet portion between the second bases, each tapering second side wall being compressible for further absorbing shocks applied to the shell, after the first-mentioned tapering side walls of the first-mentioned protrusions have been compressed sufficiently to bring the second crests into contact with the first-mentioned sheet portion, and all of the bases being spaced from each other for distributing shock absorbing effects of all the protrusions around the coverage area of the sheet portion.

2. The protective jaw pad combination of claim 1, wherein the cover (30) covers both of the first and the second shock absorbing members (12, 42) and has an outer wall (32) extending substantially across the coverage area, a side wall (34) extending around the sheet portions and protrusions of the shock absorbing members, and a perimeter (36) sealed to a perimeter of the second sheet portion (44).

3. The protective jaw pad combination of claim 2, wherein the first and second shock absorbing members are each made of thermoplastic polyurethane.

4. The protective jaw pad combination of claim 1, wherein the pad is L-shaped.

5. A protective jaw pad (10) for protective equipment (100) having a shell (110) for extending to the side of a wearers jaw, the pad comprising:

a first shock absorbing member (12) of resilient elastomer, the first shock absorbing member having a sheet portion (14) with a coverage area adapted for overlying at least part of a side of a jaw of a wearer of the equipment, and a plurality of hollow protrusions (16) made as one piece with the sheet portion and distributed around the coverage area, the protrusions each having a large diameter base (16*a*) opening into the sheet portion, a small diameter closed and flat crest (16*b*) spaced for the base, and a tapering side wall (16*c*) extending from the sheet portion to the crest, each tapering side wall being compressible for absorbing shocks applied to the shell and the bases being spaced from each other for distributing shock absorbing effects of the protrusions around the coverage area of the sheet portion;

a second shock absorbing member (20) of resilient elastomer connected to the first shock absorbing member (12) and extending over the coverage area for further absorbing shocks applied to the shell;

a cover (30) of resilient elastomer covering at least one of the first and second shock absorbing members; and a plurality of fasteners for removably connecting the jaw pad to the shell with the crests of the protrusions being closer to the shell than the sheet portion of the first shock absorbing member;

the tapering side walls (16*c*) of the protrusions (16) of the first shock absorbing member (12) having a first length for spacing the sheet portion (14) from the shell by at least the first length;

the second shock absorbing member (42) having a second sheet portion (44) with a coverage area corresponding to the coverage area of the first-mentioned sheet portion (14) of the first shock absorbing member (12), the second sheet portion having and a plurality of hollow second protrusions (46) made as one piece with the second sheet portion (44) and distributed around the coverage area of the second sheet portion, the second protrusions each having a large diameter second base (46*a*) opening into the second sheet portion, a small diameter closed and flat second crest (46*b*) spaced for a respective second base, and a tapering second side wall (46*c*) extending from the second sheet portion to the second crest of each second protrusion, each second tapering side wall (46*c*) have a second length that is shorter than the first length of the first-mentioned protrusions (16) of the first-mentioned sheet portion (14) so that the second crests (46*b*) are spaced from the first-mentioned sheet portion (14), the first-mentioned and second protrusions being interleaved with each other and the crests of first-mentioned protrusions (16) being sealed to the second sheet portion (44) between the second bases (46*a*), each tapering second side wall (46*c*) being compressible for further absorbing shocks applied to the shell, after the first-mentioned tapering side walls (16*c*) of the first-mentioned protrusions (16) have been compressed sufficiently to bring the second crests into contact with the first-mentioned sheet portion (14), and all of the bases being spaced from each other for distributing shock absorbing effects of all the protrusions around the coverage area of the sheet portion.

6. The protective jaw pad of claim 5, wherein the first and second shock absorbing members are made of thermoplastic polyurethane.

7. The protective jaw pad of claim 5, wherein the cover (30) covers both of the first and the second shock absorbing members (12, 42) and has an outer wall (32) extending substantially across the coverage area, a side wall (34) extending around the sheet portions and protrusions of the shock absorbing members, and a perimeter (36) sealed to a perimeter of the second sheet portion (44).

8. The protective jaw pad of claim 5, wherein the pad is L-shaped.

* * * * *